US011511838B2

(12) United States Patent
Mandich

(10) Patent No.: US 11,511,838 B2
(45) Date of Patent: Nov. 29, 2022

(54) HANDLE

(71) Applicant: Robert Mandich, Waianae, HI (US)

(72) Inventor: Robert Mandich, Waianae, HI (US)

(73) Assignee: Robert Mandich, Waianae, HI (US)

( * ) Notice: Subject to any disclaimer, the term of this patent is extended or adjusted under 35 U.S.C. 154(b) by 180 days.

(21) Appl. No.: 16/850,976

(22) Filed: Apr. 16, 2020

(65) Prior Publication Data

US 2020/0331575 A1 Oct. 22, 2020

Related U.S. Application Data

(60) Provisional application No. 62/834,435, filed on Apr. 16, 2019.

(51) Int. Cl.
*B63H 16/04* (2006.01)

(52) U.S. Cl.
CPC ..... *B63H 16/04* (2013.01)

(58) Field of Classification Search
CPC ..... B60H 16/04; B60H 2016/043; B60H 2016/046
See application file for complete search history.

(56) References Cited

U.S. PATENT DOCUMENTS 3,091,781 A * 6/1963 Wisbrod ..... B63H 16/04 416/70 R

* cited by examiner

*Primary Examiner* — Jacob M Amick
(74) *Attorney, Agent, or Firm* — Hawaii Patent Services; Nathaniel K. Fedde

(57) ABSTRACT

This invention provides paddle handles comprising one or more improvements. For example, the invention provides paddle handles comprising one or more of an arcuate shape, a plurality of surface channels, a surface channel comprising one or more channel branches, and a recessed outer portion.

20 Claims, 19 Drawing Sheets

HANDLE

TECHNICAL FIELD

The present invention relates to paddle handles.

BACKGROUND

Few ergonomic handles in the prior art have attempted to address the problem of anatomical laterality or dual armed usage with full consideration for distinctly alternating angular body positions during canoe paddling or long handled broom use from left-hand to right-hand usage to increase efficiency, safety and lessen injury to the user, through the enhanced alignment of respective tool shafts with the user's body core, arms, hands, wrist, thumb and fingers. It is advantageous in canoe or stand-up surfboard paddling for the blade of the paddle to enter the water vertically directly next to the watercraft and in plane with the craft, as the power of the paddling stroke is greatly increased while reducing the angular torque, which tends to send the watercraft off course, without employing a compromised stroke. Awkward and loose gripping handles contribute to unnatural core body muscle twisting due to hand grip position overcompensation that not only reduce efficiency, but also leads to fatigue of the respiratory system, strain injury to the wrists, arms, and torso, and uneven pressure on the paddlers fingers, joints, blistering of the skin due to repetitive motion and misalignment of the body core and extremities. Handles in the prior art do not support the direct and proper application of optimum body language and thus require a relatively tight and uncomfortable compromised grip to keep from being dislodged by the hydrodynamic and aerodynamic forces of vigorous paddling or tool use, or an undesirably overly loose grip which create aerodynamic drag, and contribute to hydrodynamic turbulence.

Those few inventions for handles that have addressed the problem of anatomical laterality have included mechanical solutions such as a pivot or other mechanical means to adjust the blade angle to a new rotational angle position by disengagement of their handles angle setting to rotate the grip. By setting the blade pitch angle into the paddle via mechanical means, the turning torque normally created with prior art paddles can be eliminated. The mechanical solutions disclosed in the aforementioned art require extra movement, and precious time over the course of thousands of repeated angle adjustments, are unduly burdensome, heavy, expensive and all require manipulation of the handle position itself relative to its shaft axis and paddle positioning repeatedly in order to make correction, and have no place in the practice of competitive canoe paddling or efficient work tasks, as evidenced by the lack of product in the marketplace.

There have been many handle designs exhibited in the prior art, and all exhibit the failure to adequately address the basic problem in which canoe racing requires the user changeover their grip through the quick release of their hand grip and their quick re-grip of the handle from left hand grip to right hand grip and back, a multitude of times over the course of a canoe or paddle board race, often in panic, under stress, and under fatigue effectively, with precision, without loss of speed or efficiency, without loss of secure contact, and without contributing to overuse injuries. This problem is known to the present inventor for paddlers who, for example, race under conditions requiring a stoke rate of at least 60 to 80 stokes per minute, and hence a change over from one side of the craft to the other side of the craft precisely in less than a half of one second in order to set up and complete a full stroke in less than a one second count. None of the previous art allow the handle to be placed quickly with precision and without loss of secure grip, from one hand to the other to a known preferred position, in canoe, industrial or home use such as a mop or broom tasks, or which enable quick insertion into the water in the case of canoe paddling or stand up board surfing, when the objective is to complete the task with speed and in haste under high stress condition of high speed paddling.

SUMMARY OF THE INVENTION

The invention provides improved paddle handles. A paddle handle of the invention comprises one or more of the following features:

a. An arcuate shape having a convex palm-side and a concave fingertip side ("Arcuate configuration");
b. Five surface channels, each providing an independent finger position ("5-channel configuration"), e.g. a central channel, a first pair of outer channels, and a second pair of outer channels, wherein the first pair of outer channels is opposingly (e.g. symmetrically) disposed a first distance from the central channel and wherein the second pair of outer channels is opposingly (e.g. symmetrically) disposed a second distance from the central channel;
c. At least one surface channel comprising one or more channel branches ("branched-channel configuration"), e.g. a central channel having one or more branches ("branched center channel") and optionally a pair of outer channels opposingly (e.g. symmetrically) disposed from the central channel wherein each of the pair of outer channels comprise one or more branches ("branched outer channels");
d. A side configured for interfacing the palm (palm side) having an outer portion that is recessed relative to a central portion such as a stepdown configuration.

Each of said features independently provides a distinct new and surprising functionality to a paddle handle. Further, these features and their respective functionalities can be combined. Accordingly, the invention contemplates a paddle handle having any one, two, three, or four of said features. For example, the following four embodiments illustrate useful paddle handles comprising one or more of said features.

In one embodiment, the invention provides a paddle handle having an arcuate configuration and optionally comprising a stepdown configuration. Such a configuration can optionally further comprise a 5-channel configuration and/or a branched-channel configuration.

In one embodiment, the invention provides a paddle handle having a 5-channel configuration and optionally comprises a branched-channel configuration, wherein at least one of the five channels comprises one or more channel branches. For example, a central channel can comprise one or more channel branches. Additionally or alternatively to such a branched center channel, each of a first pair of channels opposingly (e.g. symmetrically) disposed a first distance from the central channel can comprise one or more channel branches (i.e. branched outer channels). Optionally, the paddle handle further has an arcuate configuration and/or a stepdown configuration.

In one embodiment, the invention provides a paddle handle having a branched-channel configuration. Optionally, the paddle handle comprises at least one channel having a first branch on a first side (e.g. palm side) of the paddle handle and a second branch on a second side (e.g. fingertip side) of the paddle handle. Optionally, the paddle handle comprise two or three channels, each having such a first branch and/or such a second branch. For example, the paddle handle can comprise a branched center channel and/or a pair of branched outer channels. Optionally, in addition to one, two, or three branched channels, the paddle handle comprise two channels that may be branched or non-branched (e.g. the paddle handle may have a 5-channel configuration). Optionally, the paddle comprises an arcuate configuration and/or a recess (e.g. stepdown) configuration.

In one embodiment, the invention provides a paddle handle having a recess about an outer portion of the palm side, such as a stepdown. Optionally, the paddle handle comprises any of the features described above or herein.

BRIEF DESCRIPTION OF THE DRAWINGS

In FIG. 9B, the user's pinkie finger is wrapped around to the fingertip side of the handle. In FIG. 9A, the user's pinkie finger is curled in to remain on the palm side of the handle, with the back of the user's pinkie finger interfacing a stepdown.

DETAILED DESCRIPTION OF THE INVENTION

Overview

The present invention contemplates paddle handles comprising various features described herein. Each of the features may be present independently or in combination with the other features described herein.

Surface Channels

Figure 1A:
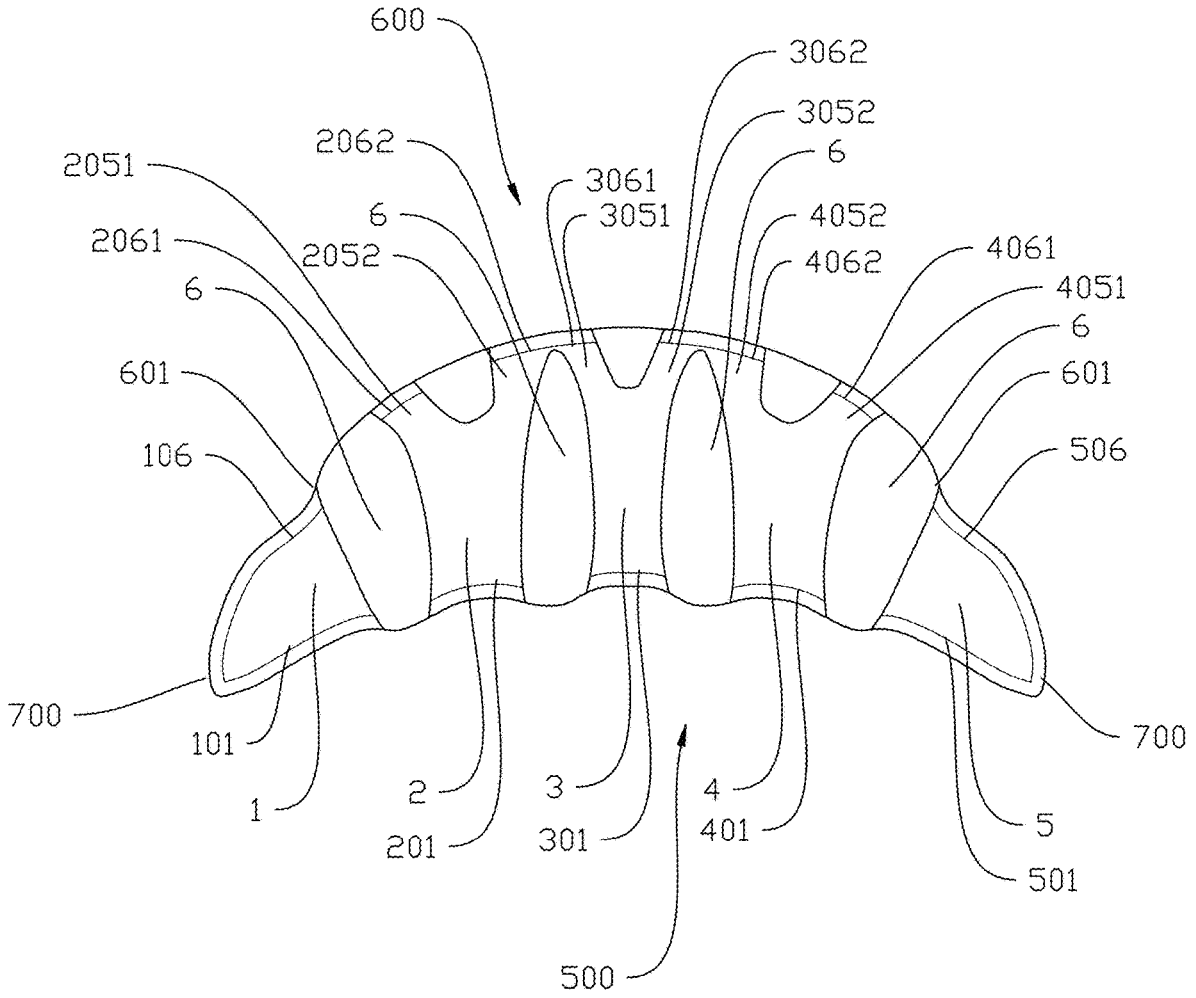
FIG. 1A depicts a top view of a paddle handle of the invention.
Figure 2A:
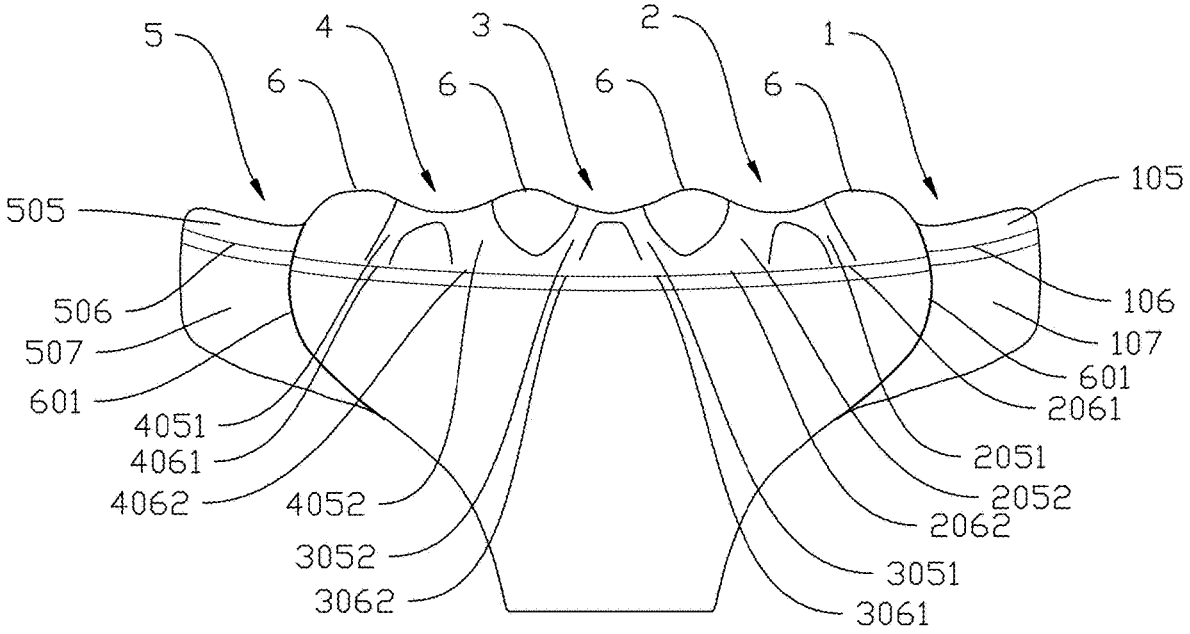
FIG. 2A depicts a back (palm side) view of the paddle handle.
Figure 4A:
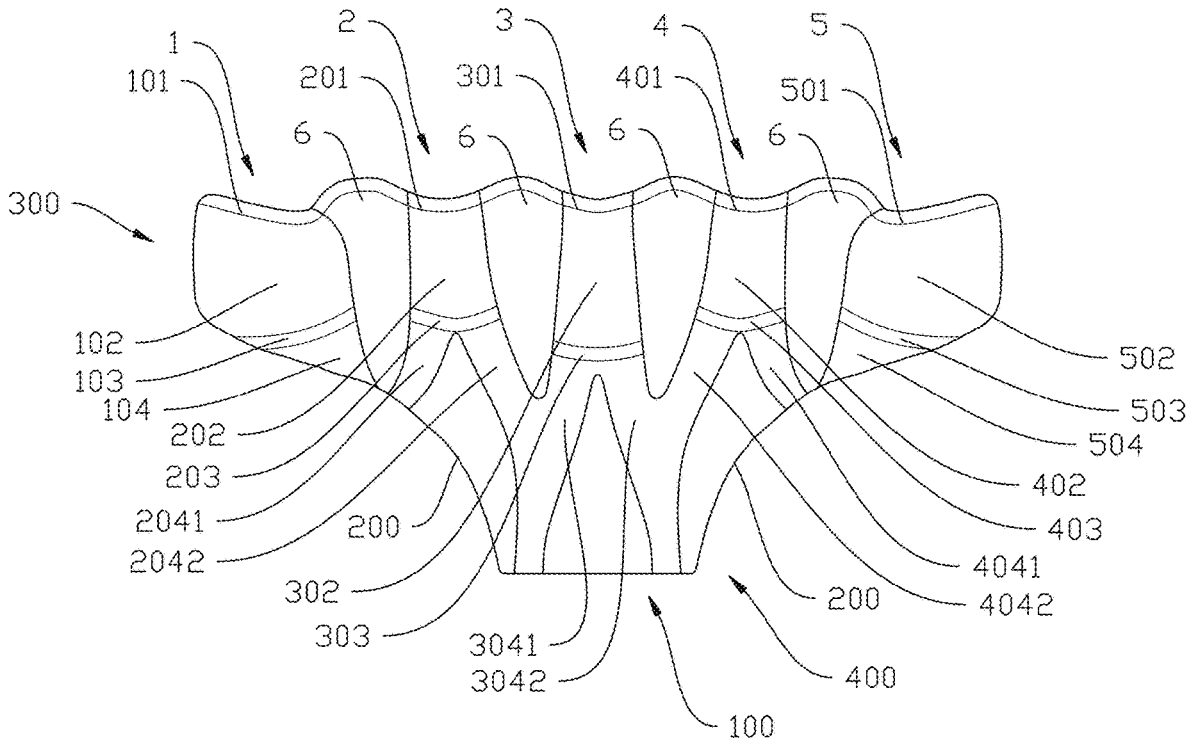
FIG. 4A depicts a front (fingertip side) view of the paddle handle.
Figure 4B:
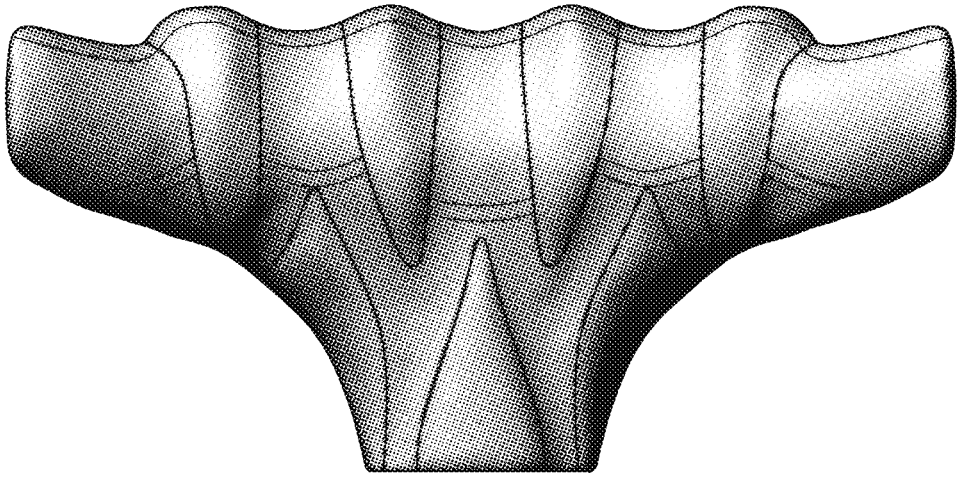
FIG. 4B depicts a shaded view thereof, illustrating contour.
Figure 5A:
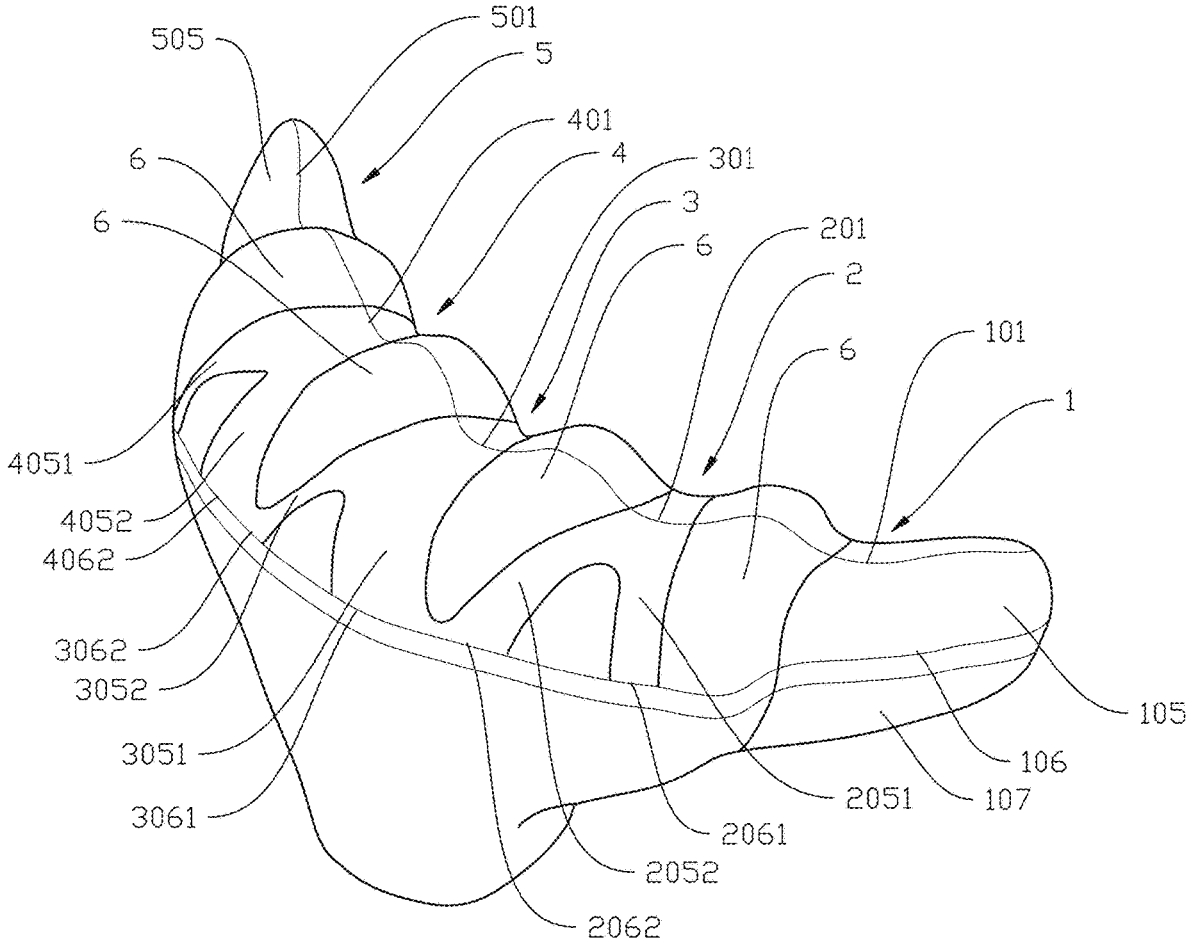
FIG. 5A depicts a rear perspective view of the paddle handle.
Figure 5B:
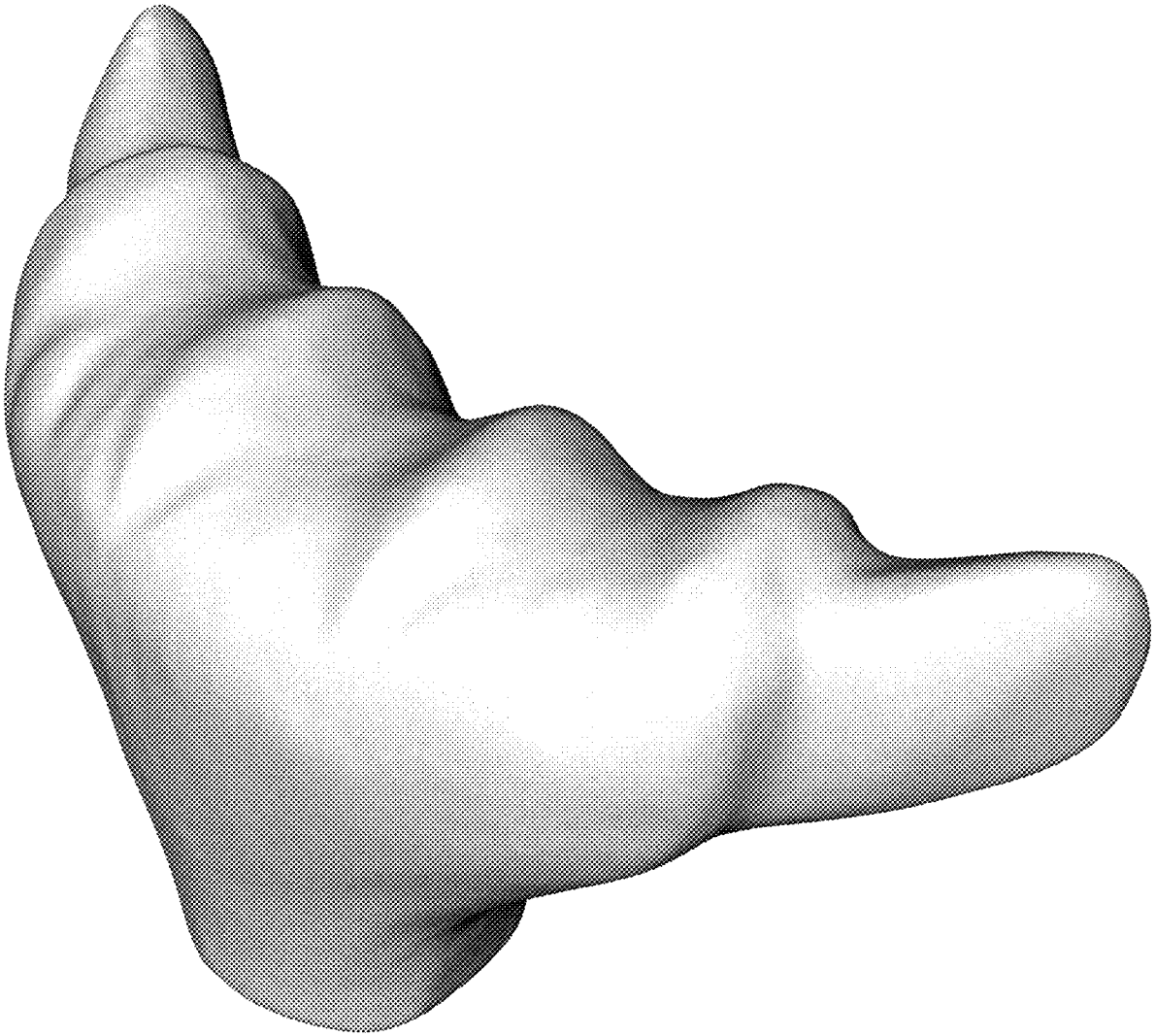
FIGS. 5B and 5C depict a shaded view thereof, illustrating contour. Unlike FIGS. 1A-5A, the overlaid lines are removed in FIGS. 5B and 5C to show an example of how subtle the features may be (e.g. channels, branches, etc.) and how the features may optionally exists without hard edges.
Figure 5C:
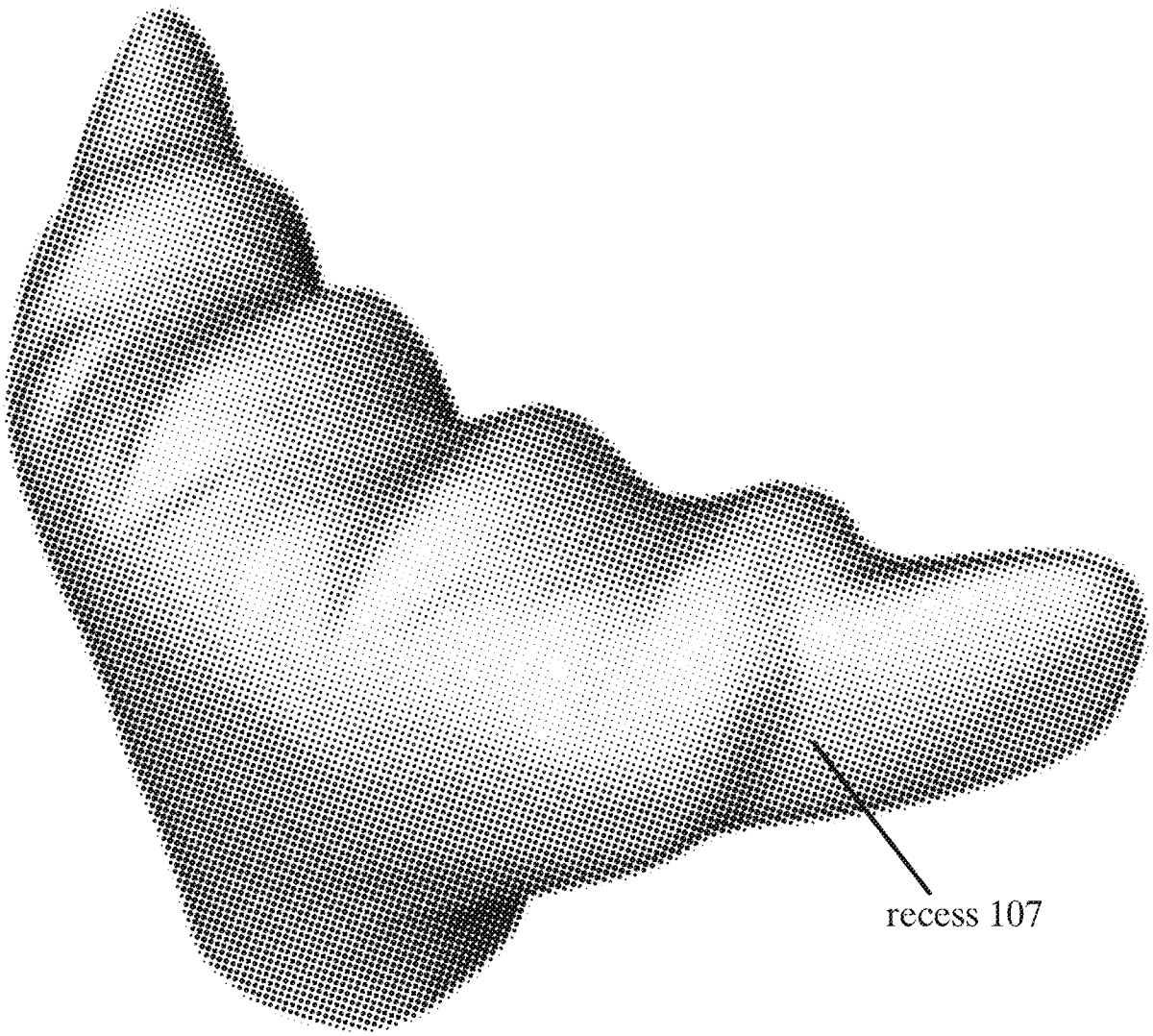

A paddle handle of the invention can comprise one or more surface channels (referred to herein as simply 'channels') such as channels 1, 2, 3, 4, 5 (FIGS. 1A, 2A, 4A). According to the present invention, a channel can be any elongated, groove, trench, or furrow. A channel useful in the present invention can be oriented such that, when present on a palm side or fingertip side, it travels parallel or substantially parallel (+/−45 degrees, e.g. for channel branches which angle away from the primary channel) to the shaft of a paddle on which the paddle handle is connected or on which the paddle handle is configured for connection.

Optionally, any channel taught herein can be positioned on a first side or "surface" (e.g. fingertip side, viewable from FIG. 4A), a second side (e.g. palm side, viewable from FIG. 2A), and/or a top side of the paddle handle (e.g. viewable from FIG. 1A). For example, the channel can extend from the first surface of the paddle handle, over the top of the paddle handle, and to the second surface, as shown in the figures. Such extension of channels from lateral surface to lateral surface (over the top or upper surface) is said to be "circumferential" as it occurs about the surface of the handle (although not necessarily requiring extension around a perfect circular shape).

Optionally, a paddle handle comprises a plurality of channels (e.g. 2, 3, or 5 channels). In such a configuration, the channels can be disposed parallel and adjacent to one another. Such channels can be disposed on the same surface (e.g. fingertip side 500, palm side 600, or top side) and be separated by respective ridges 6 (e.g. exhibiting the pattern, channel, ridge, channel, etc.).

Channel Branches

Optionally, a channel comprises a branch such that the channel splits into two or more channels (e.g. forming a "Y" branch). A channel comprising a branch is sometimes referred to herein as a branched channel. The portion of the channel before the branch is sometimes referred to as the primary channel and the portions of the channel after the branch are sometimes referred to as secondary channels. A branched channel provides a configuration in which a user may place a first portion of a finger in the primary channel and then choose which of the secondary channels to place a second portion of the finger.

For example, primary channel 3 (e.g. a centralized channel) can have, on the palm side 600 secondary channels 3051, 3052. Additionally or alternatively, primary channel 3 can have secondary channels 3041, 3042 on the fingertip side 500.

As another example, primary channel 2 (e.g. a channel offset from the center) can have, on the palm side 600 secondary channels 2051, 2052. Additionally or alternatively, primary channel 2 can have secondary channels 2041, 2042 on the fingertip side 500. Similarly, primary channel 4 can have, on the palm side 600 secondary channels 4051, 4052. Additionally or alternatively, primary channel 4 can have secondary channels 4041, 4042 on the fingertip side 500.

Figure 9A:
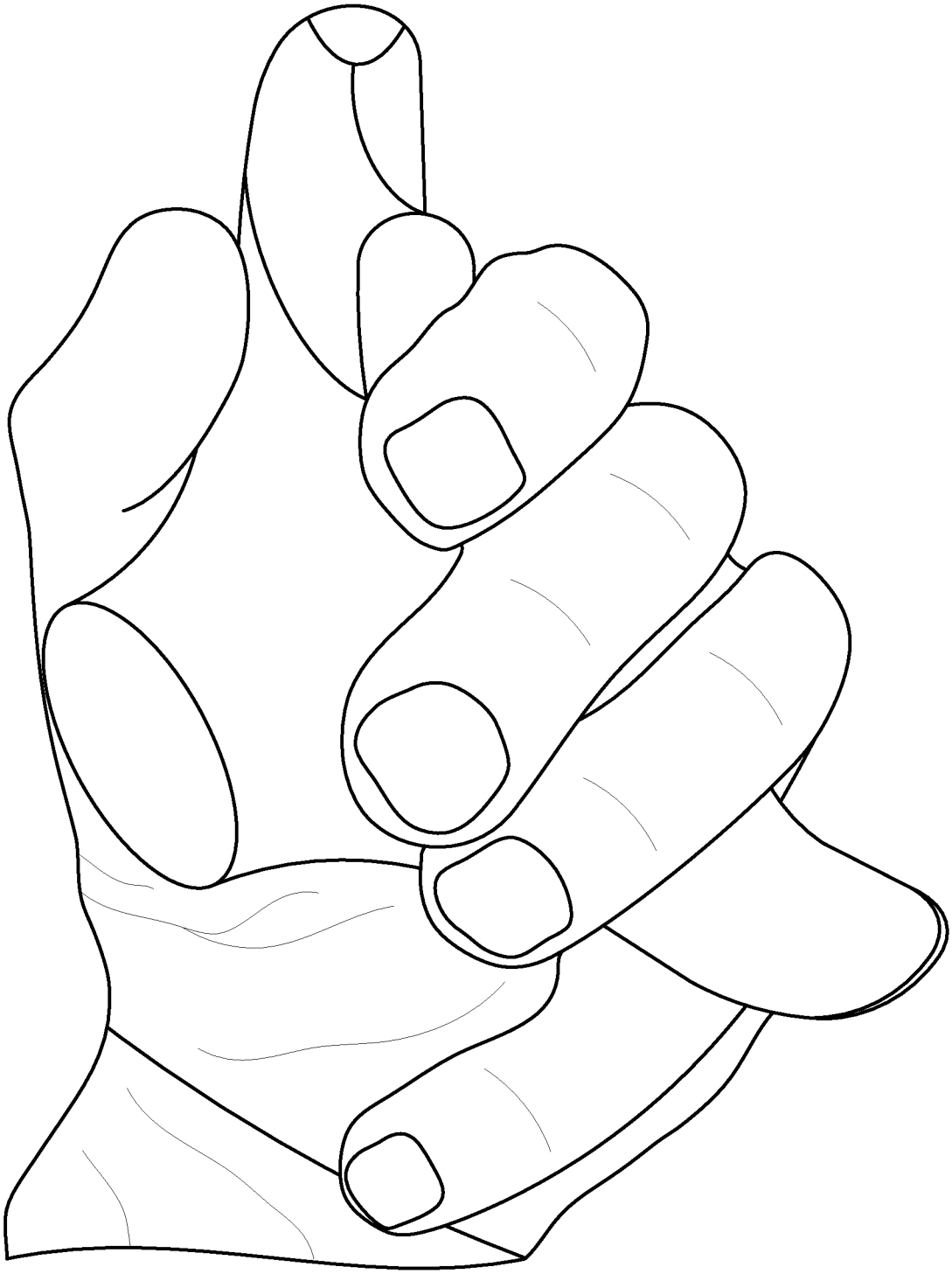
FIGS. 9A and 9B depict a user's hand holding the paddle handle in various orientations.
Figure 9B:
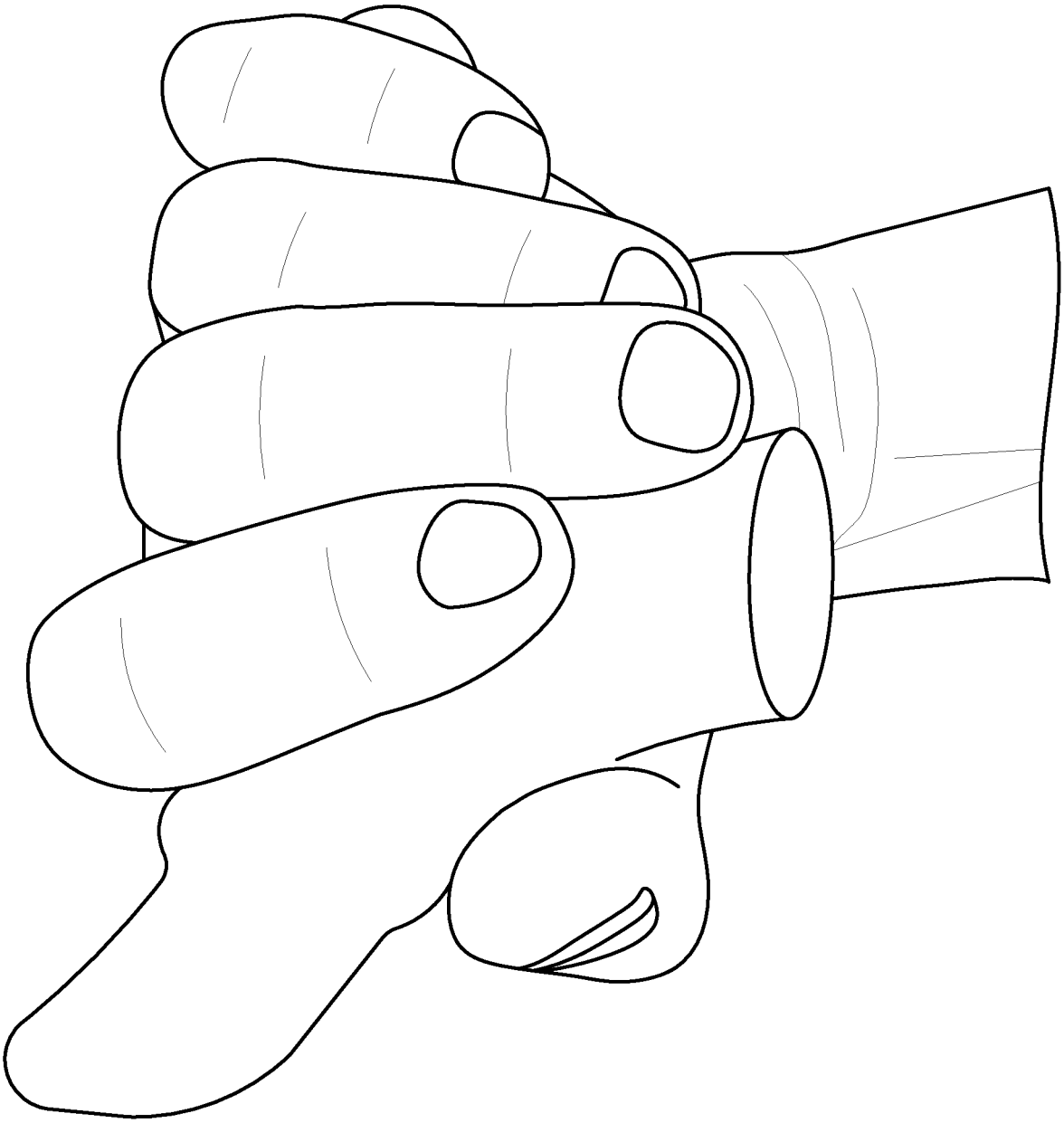

The present inventor has discovered that, while users typically grip a paddle handle such that a finger runs substantially parallel with the paddle shaft, it is ergonomically advantageous to allow the lower and/or upper portion of a finger to drift off laterally to provide a comfortable and functional grip (as shown in FIG. 9A, noting that the fingers angle to the side rather than extending directly towards the base). However, because the right and left hands are mirror images of each other, such a lateral drift would occur in opposite directions when comparing the left hand to the right hand. The present inventor further discovered that a branched channel can be provided to allow the finger to drift in either direction by appropriately selecting one of the secondary channels of a branch to receive a portion of the finger. Thus, one use of a branched channel is to allow a single paddle handle to be held by either the right or left hand, wherein a finger of the left hand preferentially uses one of the secondary channels and a finger of the right hand uses another of the secondary channels. Useful branches include those that split into two secondary channels as the channel travels towards the hand base or shaft of the paddle (i.e. the secondary channels are closer to the shaft than the main channel).

Optionally, a branched channel comprises a branch on a first side (e.g. palm side) or a second side (e.g. fingertip side) of the paddle handle. When a channel comprises a branch on a palm side of the paddle handle, the user can decide which of the secondary channels will be occupied by a lower portion of the user's finger, while an upper portion (or middle) portion of the user's finger will occupy the main channel. When a channel comprises a branch on a fingertip side of the paddle handle, the user can decide which of the secondary channels will be occupied by an upper portion of the user's finger (e.g. fingertip), while a middle portion (or lower) portion of the user's finger will occupy the main channel.

Optionally, a channel comprises two branches, e.g. a branch at each of two opposing ends of the channel. In such a configuration, a first end of the channel can branch into two or more channels and a second end of the channel can branch into two or more branches (e.g. forming a "Y" branch at one end and a "Y" branch at another end). For example, channel 3 branches to 3051,3052 on palm side and branches to 3041, 3042 on fingertip side). When a channel comprises a first branch on a palm side and a second branch on the fingertip side of the paddle handle, the user can decide which of the secondary channels of the first branch will be occupied by a lower portion of the user's finger (palm side), and which of the secondary channels of the second branch will be occupied by an upper portion of the user's finger (e.g. fingertip side), while a middle portion of the finger occupies the main channel. A channel having a "Y" branch at one end and a "Y" branch at another end is sometimes referred to herein as a butterfly (somewhat resembling a butterfly bandage strip).

Optionally, the paddle handle comprises a branched central channel (e.g. having one or two branches as taught herein). In such a configuration, when the paddle handle is gripped by the right hand, the middle finger can use the main channel and one of the secondary channels of each branch. When the paddle handle is gripped by the left hand, the middle finger can use the main channel and another of the secondary channels of each branch. Accordingly, this configuration provides an ergonomic orientation that not only allows the middle finger to drift to the side in a channel, but provides an ambidextrous paddle handle that can be used by either the left or right hand.

Optionally, the paddle handle comprises a central channel 3 (branched or non-branched) and further comprises a pair of outer channels 2, 4, one on either side of the central channel, wherein each of the outer channels is branched (e.g. each of the outer channels having one or two branches as taught herein). Such a handle can be configured such that, when the handle is gripped by the right hand, the index finger occupies a first of the outer channels and the ring fingers occupies a second of the outer channels, and conversely, when the handle is gripped by the left hand, the index finger occupies the second of the outer channels and the ring fingers occupies the first of the outer channels. Further, the branches can be configured such that the index finger of the right hand and the ring finger of the left hand, although occupying the same main channel (when held in the respective hand), would each occupy a different secondary channel of a branch that splits of the main channel. Accordingly, this configuration provides an ergonomic orientation that not only allows the index finger and ring finger to drift to the side in a channel, but provides an ambidextrous paddle handle that can be used by either the left or right hand.

Channel Bumps

Surface channels can optionally be configured with one or more channel bumps 506, 4061, 4062, 3062, 3061, 2062, 2061, 106, 103, 203, 303, 403, 503. A channel bump can be configured to run across the channel (e.g. perpendicular to the direction of travel of the channel). A channel bump provides an ergonomic interface for a respective anatomical structure of a user's hand (e.g. a finger joint).

Optionally, the paddle handle comprises one or more channel bumps 101, 201, 301, 401, 501 configured to interface the proximal interphalangeal joint of the finger. These bumps are optionally provided about the top the paddle handle.

Optionally, the fingertip side 500 of the paddle handle comprises one or more channel bumps 103, 203, 303, 403, 503 configured to interface the distal interphalangeal joint of the finger.

Optionally, the paddle handle comprises one or more channel bumps 106, 2061, 2062, 3061, 3062, 4062, 4061, 506 configured to interface the metacarpophalangeal joint of the finger. These bumps are optionally provided about the palm side 600 the paddle handle.

Optionally, for branched surface channels, each of the branches of a channel can have a respective bump, e.g. equally distanced from the branch.

Global Shape

Figure 10:
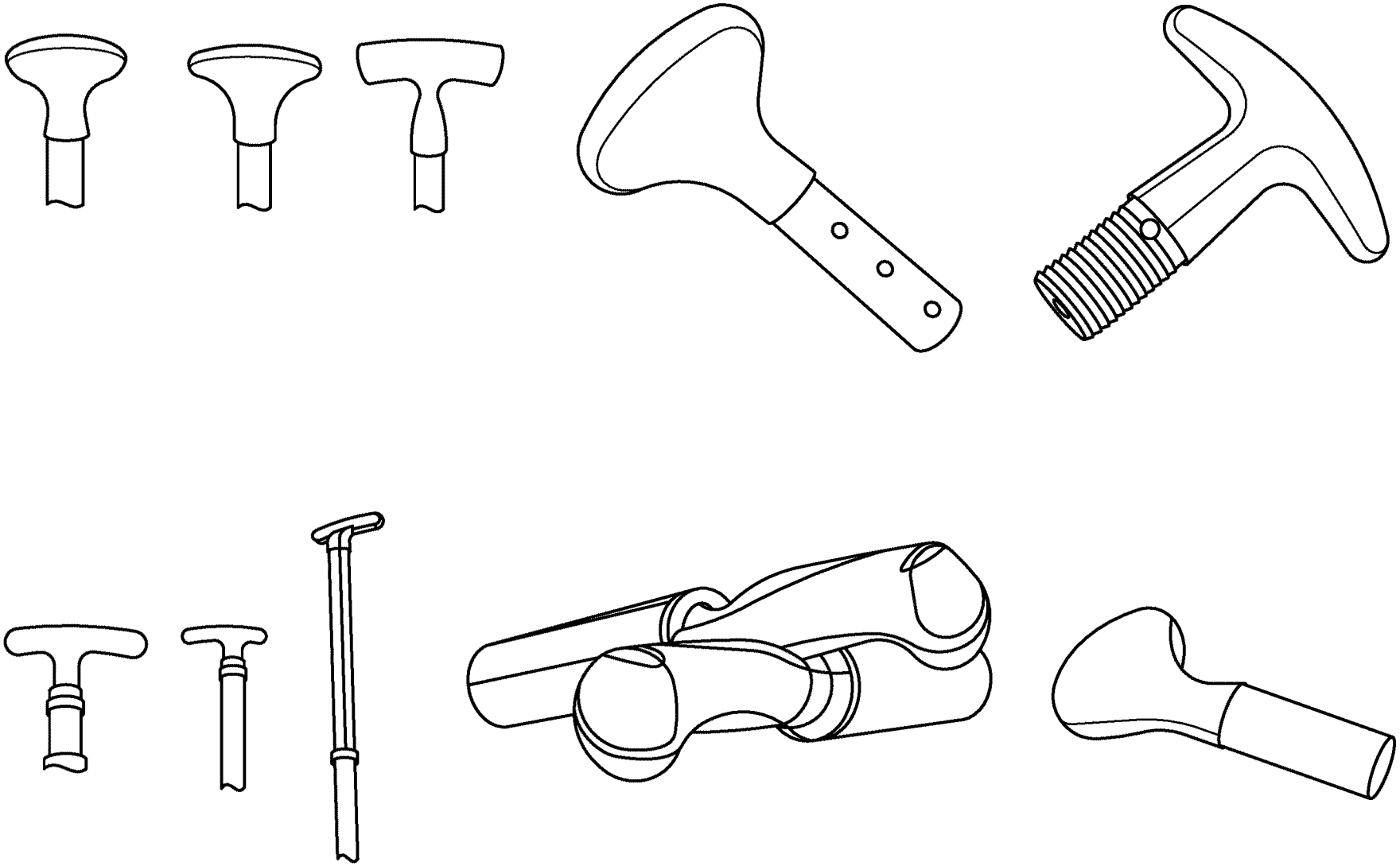
FIG. 10 illustrates optional global (overall) shapes that a paddle handle of the invention can have (e.g. features of the invention such as arcuate shape channels, branches, and/or stepdown can be added to these global shapes).

The global or overall form of a paddle handle of the invention can have any shape. Many useful shapes of paddles handles are known in the art. For example, it can be triangular (or forming a triangular prism), cylindrical (e.g. a "T" paddle handle), oblate or prolate (e.g. forming an oblate or oblique spheroid). Examples of useful global shapes are shown in FIG. 10)

Optionally, the paddle handle is wider (from terminal end 700 to opposing terminal end 700) than it is thick (from palm side 600 to fingertip side 500). For example, the ratio of width to thickness can be at least about 3:2 or at least about 2:1.

Arcuate

Optionally, a paddle handle of the invention can have an arcuate shape. In such a configuration, the paddle handle has a convex palm side 600 and a concave fingertip side 500, e.g. as shown in FIG. 1A. The term convex and concave refer to the overall shape of the respective side, noting that, for example, the fingertip side 500 can have bumps 6, but the overall shape of the fingertip side 500 is concave. The arc can, for example, be seen from the top view of FIG. 1A (e.g. such that the arc occurs about a plane that is perpendicular to a shaft of a connected paddle).

Figure 1B:
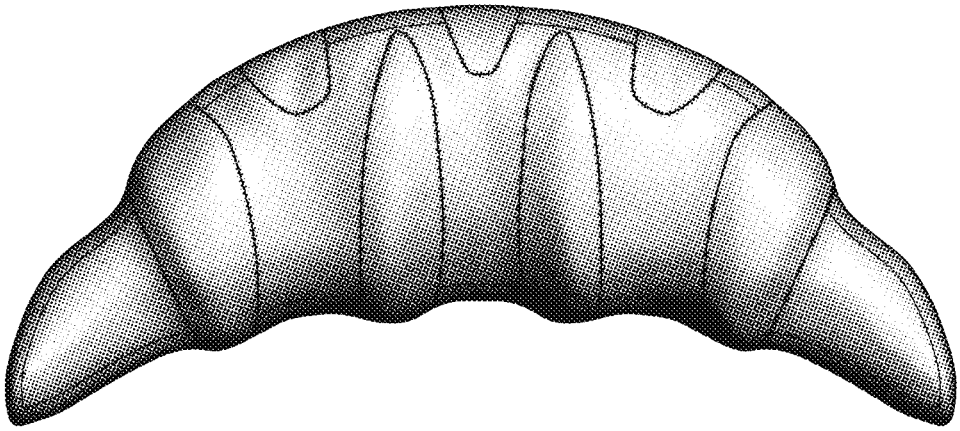
FIG. 1B depicts a shaded view thereof, illustrating contour.

Optionally, the paddle handle is arcuate and has a lateral taper, e.g. thereby providing a crescent shape as shown in FIG. 1.

Vertical Taper

Figure 2B:
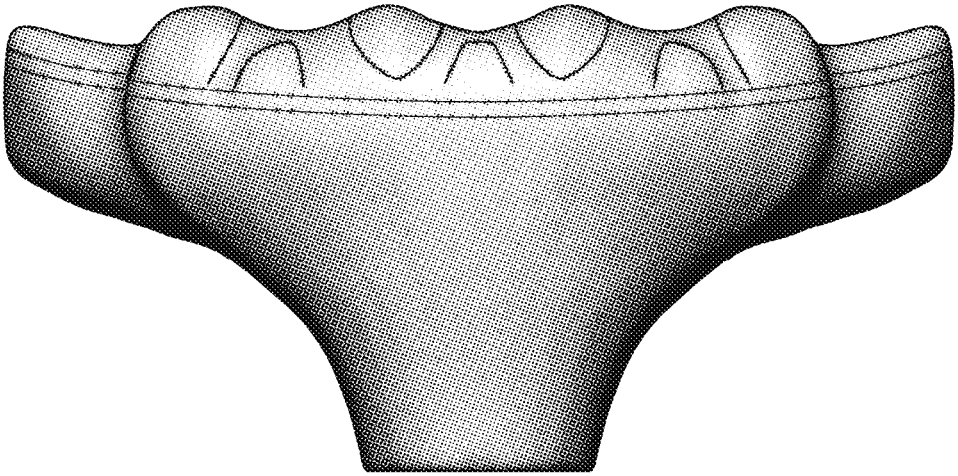
FIG. 2B depicts a shaded view thereof, illustrating contour.
Figure 3A:
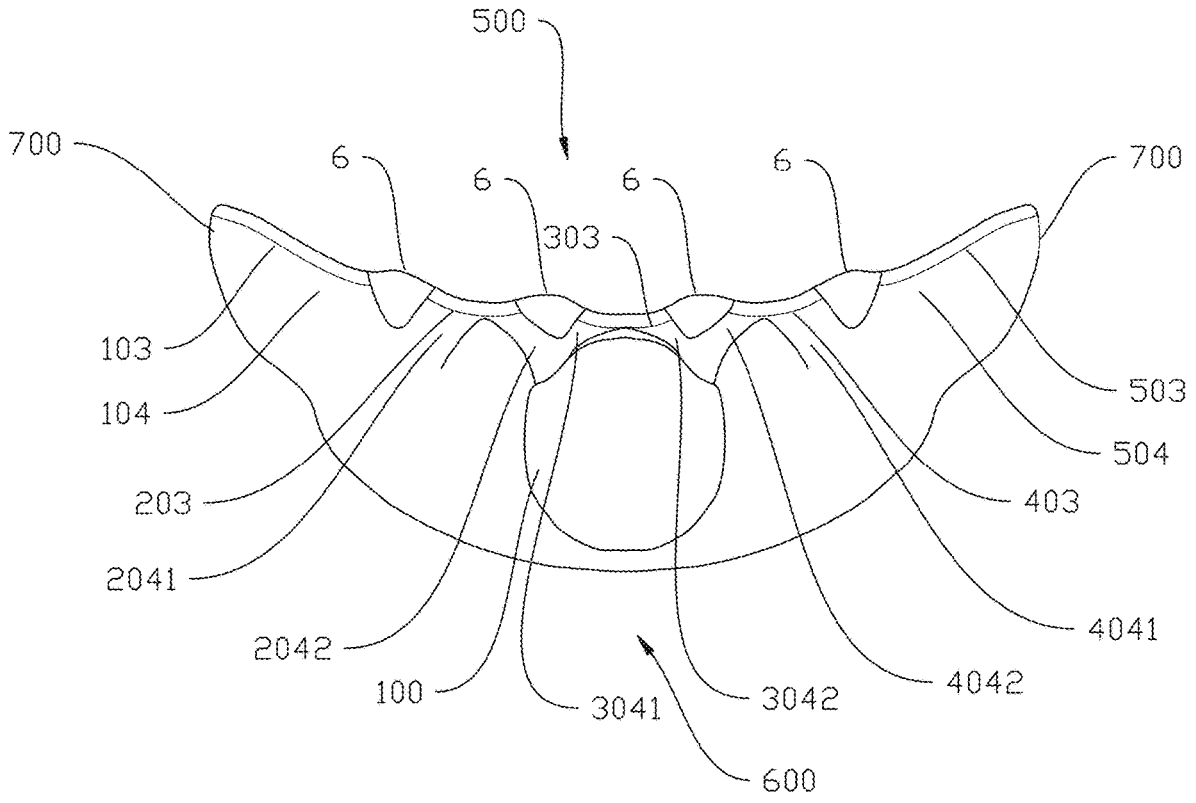
FIG. 3A depicts a bottom view of the paddle handle.
Figure 3B:
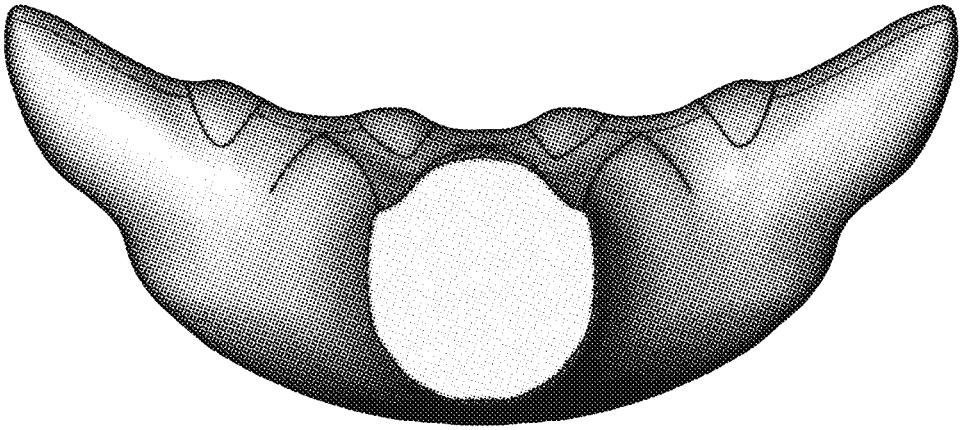
FIG. 3B depicts a shaded view thereof, illustrating contour.

Optionally, a paddle handle of the invention tapers in width from an upper portion (e.g. top side) of the paddle handle to a lower portion (e.g. portion connected to a paddle shaft). For example, as shown in FIG. 2, the paddle handle is wider about the top portion and tapers down in width to the lower portion (e.g. base). For example, when the paddle handle has an arcuate shape, it can have terminal ends 700 that extend further outward (laterally) than the lower portion (e.g. base 100 for connecting to a paddle), optionally wherein the handle tapers from the terminal ends to the lower portion via tapering surface 200 (e.g. as shown in FIG. 4A).

Lateral Taper

Optionally, a paddle handle of the invention tapers in thickness across the width of the paddle handle ('lateral taper'). For example, as shown in FIG. 1, the paddle handle is thicker in the middle (about channel 3) and tapers in thickness to terminal ends 700.

Surfaces

A paddle handle of the invention can comprises a plurality of surfaces For example, the paddle handle can have a palm side 600 and a fingertip side 600 (sometimes referred to simply as a finger side) separated by a top side, each of these sides provides a surface oriented at shaped to interface different portions of a user's hand. The surfaces can be curved and the transition from surface to surface can be gradual, e.g. such that there is no hard corner connecting the surfaces.

Optionally, the paddle can have a lower portion (e.g. having base 100) and an upper portion, wherein the upper portion comprises an upper surface (e.g. the top surface viewable from FIG. 1A) a first lateral surface (e.g. fingertip side 600 which can optionally be an inner arc surface), and a second lateral surface (e.g. palm side 600 which can optionally be an outer arc surface), wherein the first lateral surface and the second lateral surface are on opposing sides of the upper surface (e.g. such that the upper surface is between and adjoins the lateral surfaces).

Overhang

Figure 6A:
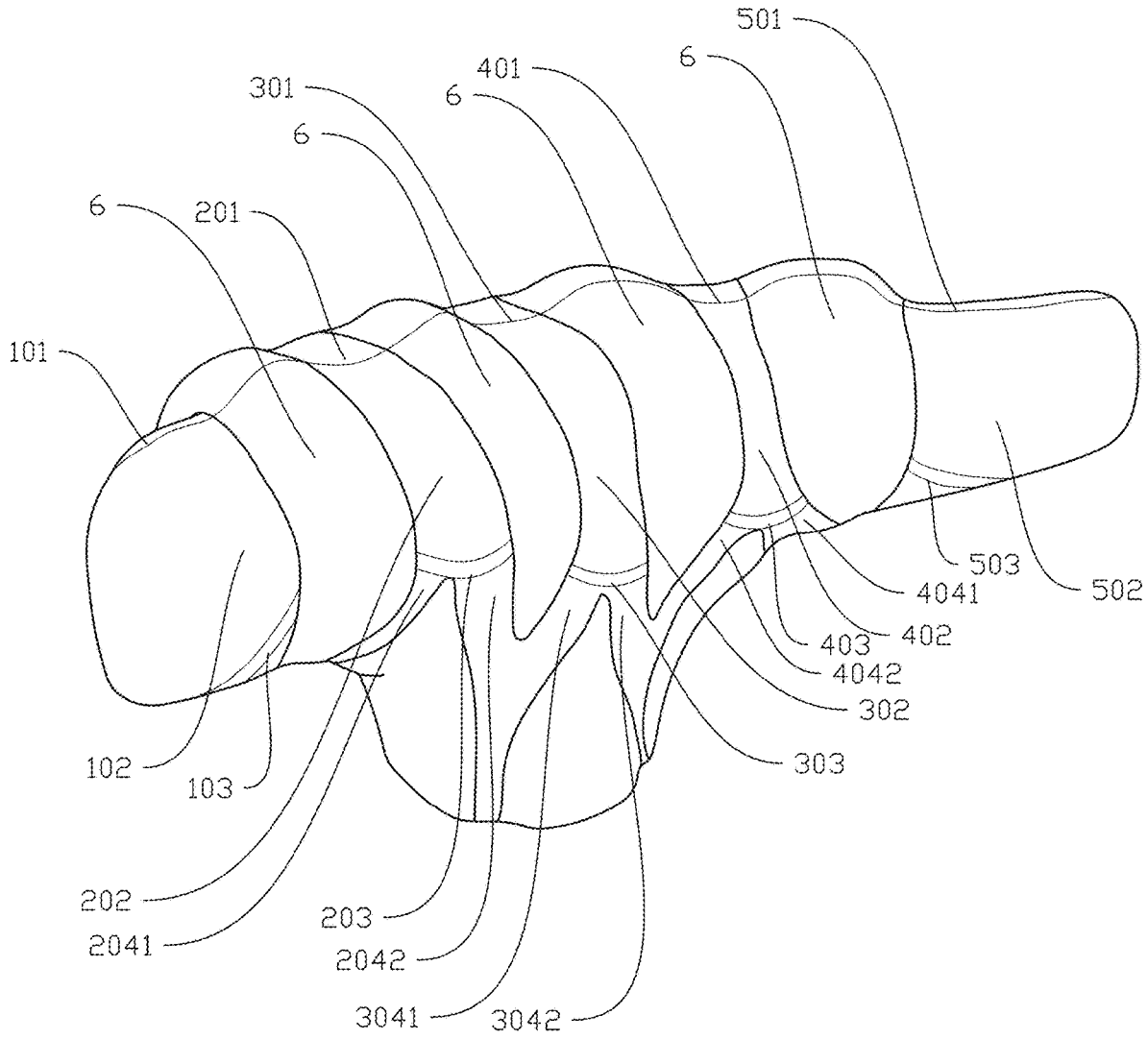
FIG. 6A depicts a front perspective view of the paddle handle.
Figure 6B:
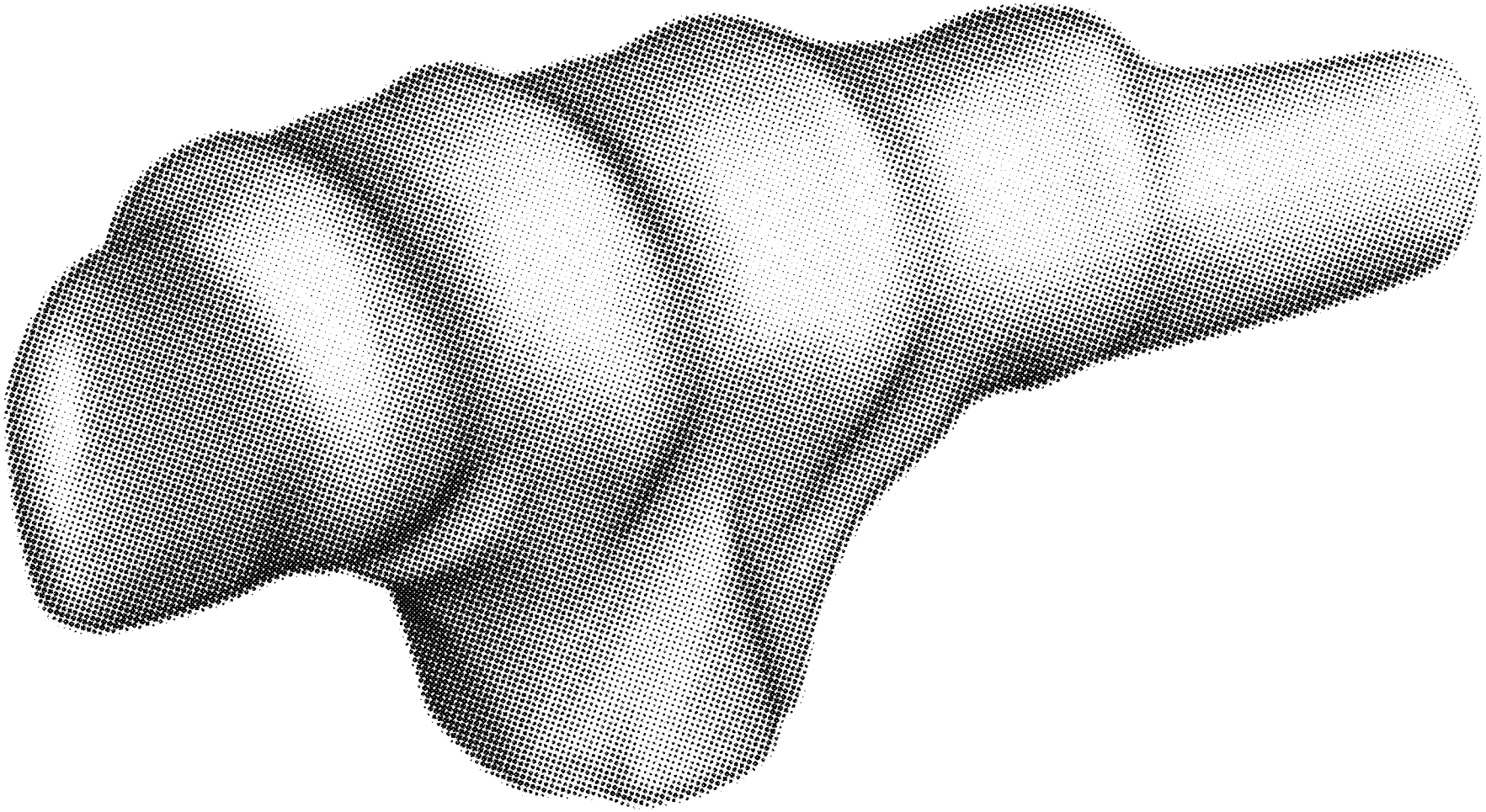
FIGS. 6B and 6C depict a shaded view thereof, illustrating contour. Unlike FIGS. 1A-5A, the overlaid lines are removed in FIGS. 6B and 6C to show an example of how subtle the features may be (e.g. channels, branches, etc.) and how the features may optionally exists without hard edges.
Figure 6C:
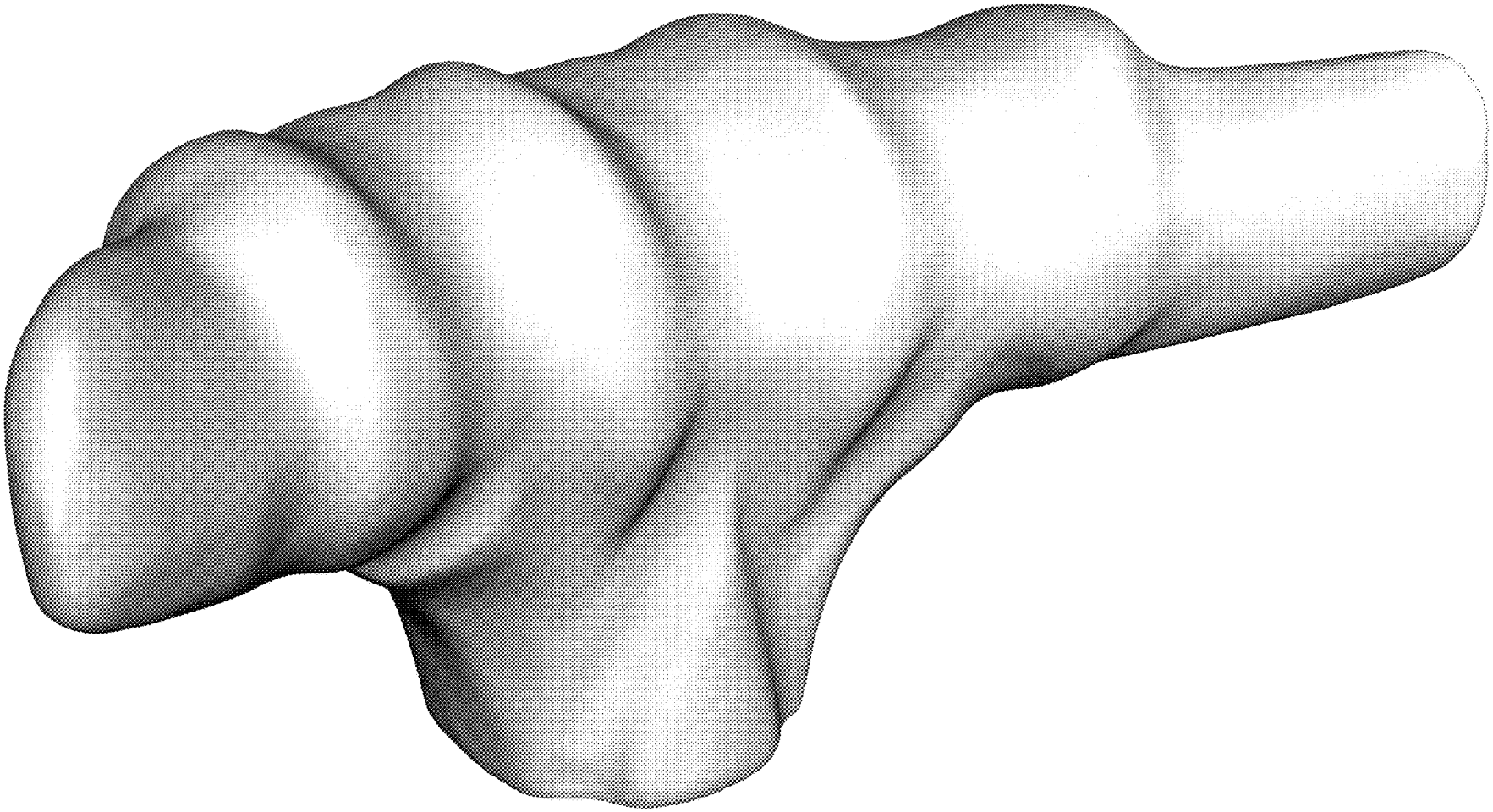
Figure 7:
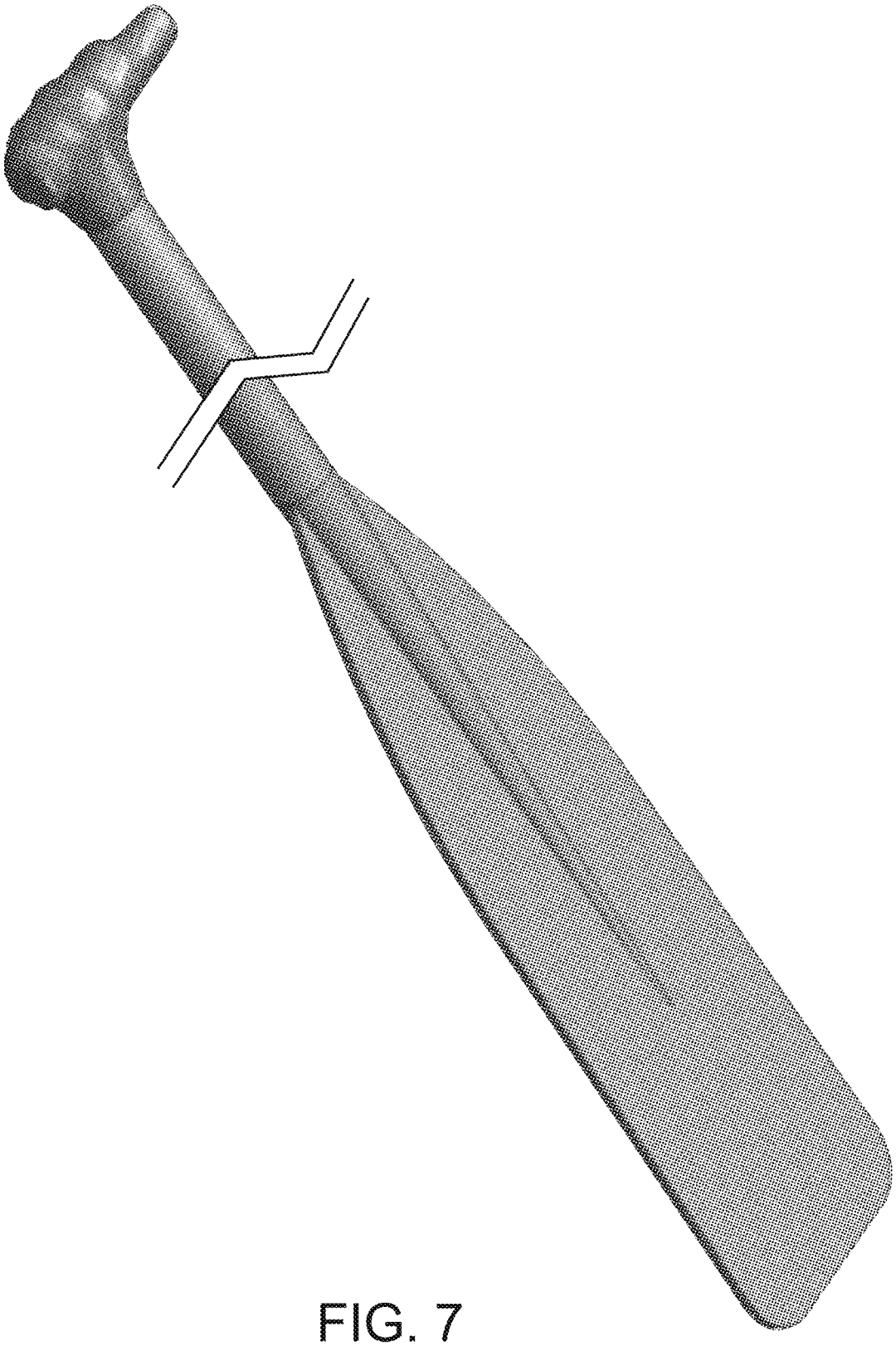
FIG. 7 depicts a paddle comprising the paddle handle.

Optionally, the fingertip side 500 of the paddle handle comprises an forward overhang about a top portion of the paddle handle (e.g. overhands the base or lower portion in a direction that extends away from the palm side, such as shown in FIG. 4A, in which the upper portion of fingertip side extends towards the viewer. Note: this forward overhang can also be seen in FIG. 6B and FIG. 6C).

Optionally, the paddle handle does not comprise an overhang on the palm side 600 (i.e. the paddle handle is asymmetric palm side to fingertip side). Alternatively, the paddle handle can comprise an overhang on both the palm side and the fingertip side, wherein the overhang is substantially greater on the fingertip side relative to the palm side.

Recess

A paddle handle of the invention can comprise one or more recesses 107, 507 on the palm side 600 (e.g. an outer arc surface), of the paddle handle, e.g. initiated by stepdown 601. The recesses can be offset to the side of the paddle handle, e.g. thereby placing the recess about an outer portion of the paddle handle (relative to the center of the paddle handle, e.g. relative to surface channel 3). The recess can be distanced from the center of the paddle handle such that, when the user's middle finger is placed about the center of the paddle handle (e.g. surface channel 3), the user's pinkie finger is positioned about the recess (e.g. as shown in FIG. 9A). For example, the recesses can be symmetrically offset from the center of the paddle handle.

While traditional paddle handles are configured to have the user wrap the pinkie finger around as with the other fingers, the recess provides an alternate location for the pinkie finger. Specifically, the recess 107, 507 provides a location for the user to curl his pinkie, placing the back side (fingernail side) of the pinkie in the recess (e.g. as shown in FIG. 9A).

Optionally, the recess 107, 507 (e.g. initiated by stepdown 601) is configured such that the thickness (from palm side to fingertip side) of the paddle handle is reduced about the recess relative to a central portion of the paddle handle, as shown in FIG. 1. This configuration provides an ergonomic thickness about the central portion to allow the index, middle, and ring fingers a sufficient sized handle to wrap around, while reducing the thickness about the recess 601 to allow the user to comfortably tuck his pinkie to on the palm side 600.

Optionally, the recess 107, 507 initiated by a stepdown 601. Such a stepdown recess is an abrupt recess, as opposed to a gradual taper. As taught herein, paddle handle can be configured with a taper (e.g. crescent shape), which can be a gradual (e.g. constant) change in slope of the palm side 600 (e.g. a smooth arc). However, a stepdown, which can optionally by combined with the tapering central portion, provides a substantial change in slope relative to a portion of the palm side immediately proximal to the center of the paddle handle (e.g. as shown in FIG. 1A, noting that the handle has an overall taper from the center, and also has a step down 601). This abrupt change in slope is present in stepdown 601. Optionally, distal to the stepdown (relative to the center of the paddle handle), the palm side 600 has a second abrupt change in slope in the opposite direction, e.g. such that the slope palm side 600 distal of the step down returns to substantially the same slope or slope relatively more similar to the slope of the palm side proximal to the center of the paddle handle. For example, as can be seen in the FIG. 1, the slope of the palm side 600 near bump 106 (which is present is recesses 107, 507, although not labeled in FIG. 1) is similar to that of bump 2061, and separated by stepdown 601.

A stepdown 601 provides a notch to stabilize the pinkie of the user. Although a sharp step down may be used (e.g. an angle as little as 90 degrees), optionally, the stepdown 601 imparts an angle of about 120 to about 160 degrees with respect to the portions of the palm side 600 immediately adjacent to the stepdown 601 (noting that the vertex of the angle can be rounded rather than a sharp vertex, as shown in the figures). This stepdown angle provides stability to the pinkie while providing a comfortable surface to the user's pinkie.

Optionally, the recess has a width (e.g. the sideways distance along palm side) sufficient to interface the entire width a of a pinkie, e.g. is at least about 0.5 inches or at least about 0.7 inches in width.

Optionally, the thickness of the paddle handle tapers about (or after) the recess 107, 507 towards the terminal end 700 of the paddle handle, as shown in FIG. 1A Connection to Tool A paddle handle of the invention can comprise a connector for connecting to a paddle shaft or other tool (e.g. a connector at base 100) or can be provided as connected to tool such as shaft of paddle (e.g. about a terminal end of a paddle shaft).

The connection or connector can be provided about the lower portion or bottom side of the paddle handle.

The connector can comprise a cavity (e.g. vertically oriented cylindrical cavity) configured to accept a paddle shaft, or a protrusion (e.g. vertically oriented cylindrical protrusion) configured for insertion in a hollow paddle shaft.

Optionally, the connector comprises a threaded connector (protrusion or cavity) or the connector comprises a set screw or a lateral hole in the side of cavity wall configured for accepting a set screw.

Although the handle has been described with respect to paddles, the ergonomic handle can be used, not only for paddles, but also for tools and sporting equipment which improves efficiency, speed, precision, control and comfort, improving hand transitioning and solid grip contact between the shaft and the grip, and is directed toward overcoming the disadvantages and problems relative to previous handle grips used in conjunction with canoes, stand-up paddle boards, brooms, mops and other tools.

Materials

A paddle handle of the invention can be made of any material. For example, the paddle handle can be made of plastic (e.g. thermoplastic) or wood.

EXAMPLES

Example 1 Paddle Handle

The figures depict a non-limiting example of a paddle handle of the invention.

Figure 8B:
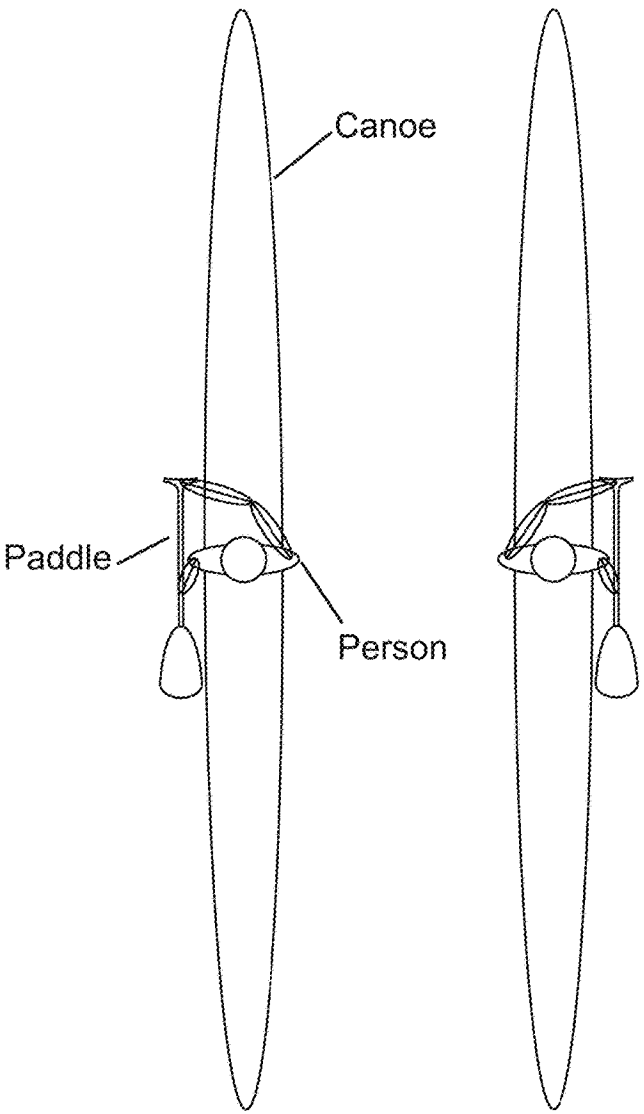
FIG. 8B depicts users paddling with a paddle comprising a paddle handle of the invention; the users' arms are in the rearward position (after the stroke).
Figure 8A:
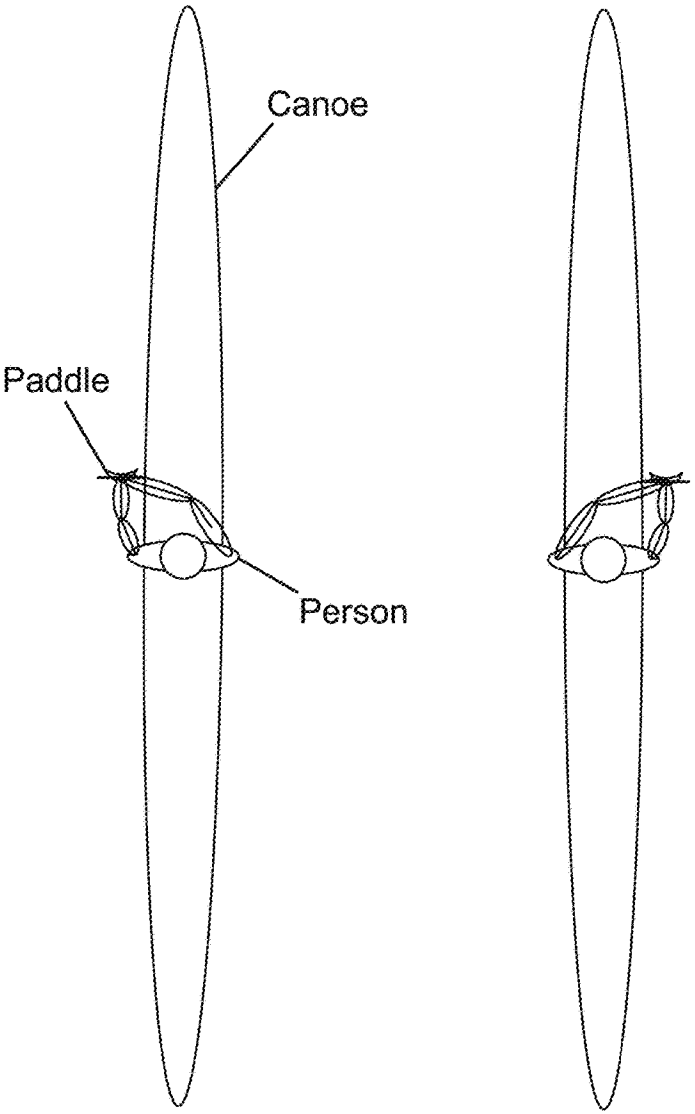
FIG. 8A depicts users paddling with a paddle comprising a paddle handle of the invention; the users' arms are in the forward position (before the stroke).

Referring to the drawings and particularly FIGS. 8A and 8B there is shown a canoeist or standup paddler from the top view showing their positions relative to their craft while in forward position to enter their paddle into the water and take a stoke, and finishing position to withdraw their paddle from the water respectively. The paddle shaft and paddle blade are aligned with and to the side of their craft ready for insertion into the water, and remained aligned with the side of their craft upon their withdrawal. The angle of repose between the paddler's arms) is at 30 to 45 degrees respective to each other, while the paddle blade remains at 90 degrees to the direction of travel. The paddle handle is symmetrical about the longitudinal axis of the paddle shaft and parallel to its paddle blade. As a result of the angular disposition through the use of its concavo/convex form of the grip portion of the handle, the canoeist's wrist remains substantially unbent throughout the stroke, greatly reducing fatigue and all the fingers of the hand firmly close about the paddle handle.

The paddle handle may be integral with the shaft or may be used with any paddle shaft to which it may be attached by design for an even and uninterrupted flow of the palm and fingers from the Paddle shaft (900) to the paddle handle. The Paddle shaft (900) may connect with the paddle handle by a keyed male and female insertion point (100) at the handle base, both having the same finished outer circumference where they meet to further smooth out the transition from hand to hand.

The handle of this invention specifies a concavo-convex form for the basic plane of the gripping portion of the handle, comprising an Inner Arc about fingertip side (500), and an Outer Arc about palm side (600). The paddle handle is formed with a concavo-convex shape reflecting the required preferred angle for the palm and fingers, in reference to the 30 to 45-degree relationship of the paddle handle arm to paddle shaft arm in relation to the direction of travel.

The paddle handle is neither adjustable, slide able or adaptable in order to correct for left or right handed use, but rather it is rigidly fixed and achieves its strength and conformability to its users position through its concavo-convex form, and the various type, angle and location of multiple thumb and finger members, which accommodate the requirements for the change of grip angles due to the relationship of both arms to the body while in use. The paddling apparatus of the present invention provides an integrated single piece designed handle, including 7 distinct fingering positions and 2 thumb positions, for a total of 9 specific digit positions.

The upper portion (300) of the paddle handle is comprised of the following. The second finger, third digit middle finger recessed Surface Channel location (3) is provided to improve the grip and accommodate the middle fingers of both the right and left hands while in use, allowing the user to exert maximum force at the center axis of the paddle handle through its paddle shaft, and its paddle blade, while in a right or left handed position. The right hand third finger, $4^{th}$ digit ring finger recessed Surface Channel location, and the left hand first finger, $2^{nd}$ digit index finger recessed Surface Channel location (2) is provided to improve the grip while in a right arm or left hand position respectively. The right hand first finger, $2^{nd}$ digit index finger recessed Surface Channel location, and the left hand third finger, $4^{th}$ digit ring finger recessed Surface Channel location (4) is provided to improve the grip while in a right hand or left hand position respectively. The right hand fourth finger, 5th digit little finger recessed Surface Channel location, (1) is provided to improve the grip while in a right-hand grip position and is located at the Terminal End (700) of the handle. The left hand fourth finger, 5th digit little finger recessed Surface Channel location, (5) is provided to improve the grip while in a left-hand grip position, and is located at the Terminal End (700) of the handle. The fingering positions (1), (2), (3), (4), and (5) are divided by Inter-Channel Ridges (6), and are further described by their component shape and angles as follows. Fingering positions (2), (3), (4) employ the added benefit of dual utility butterfly or Y shaped recessed depressions providing laterality for right and left handed use formed in the end positions of the butterfly or Y shaped recessed Surface Channel finger depressions as described on the front of the handle as the metacarpus surface 13(105, 2051, 2052, 3051, 3052, 4051, 4052, 505), and on the rear or back of the handle as the distal phalange surface 14(504, 4042, 4041, 3042, 3041, 2042, 2041, 104). Fingering positions (2), (3), (4), which feature butterfly shaping (105, 2051, 2052, 3051, 3052, 4051, 4052, 505), (504, 4042, 4041, 3042, 3041, 2042, 2041, 104), along with fingering positions (1), (5) which do not, further comprise of center transition surfaces and joints including a proximal phalange surface (1, 2, 3, 4, 5), a proximal interphalangeal joint transition (101, 201, 301, 401, 501), a middle phalange surface (102, 202, 303, 403, 502), a distal interphalangeal joint transition (103, 203, 303, 403, 503), and the metacarpophalangeal joint transition (106, 2061, 2062, 3062, 4062, 4061, 506), accommodating laterality in right to left handed use. The right hand fourth finger, 5th digit little finger alternative recessed stall location, (107,) is located at the stepdown (601) and provided to improve the grip and while in an alternative right-hand grip position, utilizing the back of the little finger to maintain position, and to further allow the user to maintain a two-point grip throughout the entire grip change process. The left hand fourth finger, 5th digit little finger recessed stall location, (507) is located at the stepdown (601) and provided to improve the grip while in a left-hand grip position, maintaining a two-point grip throughout the entire grip change process, utilizing the back of the little finger at the metacarpophalangeal joint (MOP) to maintain position, while also allowing the user to maintain a tighter grip and facilitate grip change during high speed movement.

The right-hand thumb or first digit (508), and the left-hand thumb or first digit (108) are located to insure a tight grip while also allowing for a smooth transition utilizing its tapering surface (200) from one hand to the other and is located on the Lower Portion (400) of the handle. The handle and thumb positions (508) and (108) employee a relatively steep smooth faced curved angle in excess of 45 degrees to facilitate the smooth transition of either hand along the paddle shaft (900) axis through hand and fingers transition, up onto the handle without the loss of controlled positive physical contact at full speed. The handle ( ) of this invention specifies a concavo-convex form for the basic plane of the gripping portion of the handle ( ). Within the palm of the hand itself, this resultant angle better accommodates a more secure, comforting grasp and clasping function by the little fingers through the unique use of four positions (1, 5, 508, 108) dependent on use, and a more dexterous, controlling contact with the base of all other fingers (2, 3, 4), and thumbs (508, 108). The concavo-convex form correspond to the pointing posture of the hand itself, aligning with, and providing support of the forearm's ulna end, at a more or less horizontal position, during pressing, pointing, and lifting hand postures while in use which accommodates several natural features of the hand and forearm, to achieve a relaxed, balanced, overall straight posture. The resultant angles allow space for the extended palm's natural tendency to sag with its own weight and curve downward on the little finger edge.

Example 2 Uses and Objects of the Invention

A paddle handle of the invention is, for example, useful to address such repetitive motion injuries as Carpal Tunnel Syndrome, Tenosynovitis and Lateral Epicondylitis and, to reduce such cumulative trauma by making tool and sporting equipment movements more efficient, less energy consuming and less fatiguing, while accommodating laterality in human performance, such as canoe, stand up paddling activities, and broom sweeping through the provision of optimum advantages such as those achieved by the invention.

The handle, in this invention, is specifically designed in varying sizes with the optimum angles and form set in the grip itself to address laterality of use to improve efficiency, in the balanced, secure and relaxed alignment of the wrist, arm and torso, during the process of its use, while maintaining the natural optimum flow of energy or chi through all joints, eliminating bent wrist injury, with speed and precision in order to allow the blade member to enter the water in a straight cross plane to the canoe, creating a counter-turn pressure against the user's body mass and the canoe and thus correcting the ordinary turning force experienced in prior paddles. The handle may be fully controlled by the use of two digits, the thumb and little fingers, thus allowing the remaining digits to complement and provide a secure, relaxed and controlled grip. The little finger may seat positioned above the handle or in an alternative position below the handle along with the thumb to further offer, facilitate, maintain and control two points of constant contact with the shaft at all times while used laterality and at speed through the stroke change from left to right hand and back. The little finger may alternatively switch to its upper location after the first new stroke count, or be left in place.

In order to accommodate and maintain erect postures during work and sports activities, the concavo-convex orientation shape of the gripping portions of the handle of this invention are employed, and have exceptional benefit. This orientation augments the clasping function of the hand's smaller fingers, in accordance with the overall goal of maintaining the optimum anatomical posture and minimizes potentially injurious, excessive torso flexions, while redirecting some of the leveraging movement to the side of the torso, allowing the user to employ torso body mass to supplement the muscular exertion of the limbs, and thereby substantially reducing localized user stress and fatigue. The resultant, straight overall skeletal alignment, allows a more direct transfer of body mass forces into paddle handle or tool. This configuration reduces specific muscular effort and discomfort and increases overall power, while offering a variety of safe, cumulative stress reducing, tool holding postures, while respecting the natural 45 degree's angle between right and left forearms while in use.

The presently preferred paddle handle is a dynamic and ergonomic device that facilitates paddling, sweeping, mopping in an ideal symmetric forward facing body position without undue body rotation or asymmetric forces on the body or hands themselves. The presently preferred device in paddling uses allows paddlers to increase their speed over water for extended periods of time when paddling, while reducing both the use resistance and drag on the user's canoe or stand up surfboard, allowing for increased speed and ease of use relative to the previous art.

The objective of the present invention is to obviate the disadvantages of prior handles, and to provide a new and improved ergonomic hand grip for various tools including brooms, shovels, rakes, and paddles, accommodating laterality of use with a plurality of handgrip positions that minimize excessive bending of the wrist and other joints, thus easing strain on the user's fingers, wrists, elbows, shoulders, legs, back, and other muscles, and further reducing injury caused by repetitive motion disorder, and is interchangeable with a wide variety of paddles and tools.

It is the further object of this invention is to provide a handle which directly addresses laterality of use, accomplished without mechanical adjustment of a grip mechanism to unlock/lock the grip into a changed preferred position.

It is the further objective of the invention to improve the performance of both the novice and expert paddler with various sized handgrips so that their shaft may be separate pieces, though in another embodiment of this invention they may be produced as the same piece, both of which facilitate the smooth transition change between hands.

It is the further objective of this invention to provide a handle for a tool that improves and respects tradition and the cultural aesthetic.

It is the further object of the invention to provide a handle which has uniquely sized, formed and positioned angles that accommodate digit form rather than digit pressure as a tool allowing the handle to be gripped controllably and comfortably for long periods of time.

It is the further object of this invention is to provide a handle with unique little or fifth digit finger locations having a narrow profile from the upper to lower grip locations for the same digit, in order to facilitate the use of two continuous points of contact along a shaft while used laterality during the release and re-grip process, utilizing both the thumb and little finger, as opposed to single digit or thumb contact only, which often leads to loss of contact control altogether.

It is the further object of this invention to provide an ergonomic handle is produced as a semi-rigid, or rigid one piece fabrication variable in size and material, allowing both flexibility due to its ability to conform to the individual size and shape the of user's hands and specific arm lengths and body size.

While the embodiment of the invention has been described, it will be apparent to those of ordinary skill in the art that many more embodiments and implementations are possible that are within the scope of this invention. Accordingly, the invention is not to be restricted except in light of the attached claims and their equivalents. The device forms enhanced flow though out its use, without interrupting the activity of the paddling sport in which the user is participating. The device enhances the user's ability to flow smoothly, and paddle swiftly through the water with increased capacity than without using the apparatus.

The citations provided herein are hereby incorporated by reference for the cited subject matter.

What is claimed is:

1. A paddle handle comprising an upper portion and a lower portion, wherein a. the upper portion comprises an upper surface, a first lateral surface, and a second lateral surface, wherein the first lateral surface and the second lateral surface are on opposing sides of the upper surface;

b. the paddle handle comprises five surface channels disposed on the upper surface, each extending circumferentially from the first lateral surface to the second lateral surface over the upper surface;

c. the five surface channels comprise a central channel, a pair of first channels, and a pair of second channels;

d. each of the first channels is offset a first distance outwardly to a respective side of the central channel;

e. each of the second channels is offset a second distance outwardly to a respective side of the central channel, wherein the second distance is greater than the first distance;

f. each of the central channel and each of the pair of first channels branches into two channels on the first lateral surface; and g. each of the central channel and each of the pair of first channels branches into two channels on the second lateral surface.

2. The paddle handle of claim 1, wherein each of the five surface channels is separated from each other by respective ridges.

3. The paddle handle of claim 1, wherein each of the pair of first channels is substantially symmetrical to each other about the central channel.

4. The paddle handle of claim 1, wherein each of the pair of second channels is substantially symmetrical to each other about the central channel.

5. The paddle handle of claim 1, wherein the paddle handle is substantially symmetrical about the central channel.

6. The paddle handle of claim 1, wherein one or more or all of the five surface channels comprise, about the first lateral surface, a bump in the respective channel.

7. The paddle handle of claim 1, wherein one or more or all of the five surface channels comprise, about the first lateral surface, a first bump in the respective channel, optionally wherein each of said first bumps is proximal to the upper surface or at a transition between the first lateral surface and the upper surface.

8. The paddle handle of claim 1 wherein one or more or all of the five surface channels comprises, about the first lateral surface, a second bump in the respective channel, optionally wherein each of said second bumps is proximal to the branch of the respective channel.

9. The paddle handle of claim 1 wherein the second lateral surface comprises one or more third bumps that extend substantially perpendicular to the five surface channels, wherein said one or more third bumps are positioned lower on the second lateral surface relative to the branch of the respective channel.

10. The paddle handle of claim 1, wherein one or more or all of said channels comprises, in each of the respective two branches on first lateral surface, a portion that is depressed inward further than a portion of the channel that is located before the branch.

11. The paddle handle of claim 1, wherein the upper surface comprises an arcuate shape comprising an inner arc surface as the first lateral surface and an outer arc surface as the second lateral surface.

12. A paddle handle comprising an upper portion and a lower portion, wherein a. the upper portion has an arcuate shape, b. the arcuate shape comprises lateral terminal ends that extend further outward, away from an imaginary axis that connects the upper portion and the lower portion, than the lower portion;

c. the lower portion comprises a lower end that is configured for attachment to a paddle shaft or is attached to the paddle shaft;

d. the arcuate shape comprises an inner arc surface that is concave and configured for interfacing a user's fingers;

e. the arcuate shape comprises an outer arc surface on an opposing side relative to the inner arc surface, wherein the outer arc surface is convex and configured for interfacing a user's palm; and f. the arcuate shape arcs about an imaginary plane that is perpendicular to an axis of the paddle shaft.

13. The paddle handle of claim 12, further comprising, for each of said terminal ends, a tapering surface joining the lower portion to the respective terminal end.

14. The paddle handle of claim 12, wherein the inner arc surface extends further outward than at least one portion of the lower portion.

15. The paddle handle of claim 12, wherein the arcuate shape has a greater lateral thickness about a central portion of the arcuate shape than the lateral thickness of the lateral terminal ends.

16. The paddle handle of claim 15, wherein the outer arc surface comprises, for each of said lateral terminal ends, a recess adjoining the central portion and the respective lateral terminal ends.

17. A paddle handle comprising a front lateral surface as a fingertip side and a back lateral surface as a palm side, wherein the palm side comprises a central portion between a left terminal end of the palm side and a right terminal end of the palm side, a first recess or first stepdown adjoining the central portion and the left terminal end such that the paddle handle is recessed or stepped down to the left of the central portion, and a second recess or second stepdown adjoining the central portion and the right terminal end such that the paddle handle is recessed or stepped down to the right of the central portion, the left terminal end is positioned to the left of the central portion and the right terminal end is positioned to the right of the central portion;

the paddle handle comprises a top surface connecting the front lateral surface and the back lateral surface; and the paddle handle comprises a bottom portion opposite the top surface, wherein the bottom portion is attached to a paddle or configured for attachment to a paddle.

18. The paddle handle of claim 17, wherein the paddle handle has an arcuate shape.

19. The paddle handle of claim 17, wherein the front lateral surface and the back lateral surface are provided about an upper portion and the paddle handle comprises a lower portion, wherein the upper portion tapers from the terminal ends to the lower portion.

20. The paddle handle of claim 17, wherein the paddle handle comprises the first stepdown and the second stepdown and each of the first stepdown and the second stepdown comprises an angle of about 120 to about 160 degrees with respect to a portion of the paddle handle immediately adjacent to the stepdown.

* * * * *